United States Patent [19]

Neelameggham et al.

[11] Patent Number: 4,510,029

[45] Date of Patent: Apr. 9, 1985

[54] MOLTEN SALT ELECTROSTRIPPING CELL AND METHOD FOR PURIFYING MOLTEN SALT ELECTROLYTES

[75] Inventors: Ramaswami Neelameggham, Salt Lake City, Utah; John C. Priscu, Las Vegas, Nev.; Robert D. Toomey, Salt Lake City, Utah

[73] Assignee: AMAX Inc., Greenwich, Conn.

[21] Appl. No.: 611,791

[22] Filed: May 18, 1984

[51] Int. Cl.[3] ..... C25C 3/04

[52] U.S. Cl. ..... 204/130; 204/70; 204/243 R; 204/244; 204/247; 204/268; 204/269; 204/270

[58] Field of Search ..... 204/243 R, 244, 245, 204/247, 130, 268–270, 70

[56] References Cited

U.S. PATENT DOCUMENTS

| | | | |
|---|---|---|---|
| 1,567,318 | 12/1925 | Cottringer et al. | 204/244 |
| 2,480,474 | 8/1949 | Johnson | 204/268 |
| 2,629,688 | 2/1953 | Hunter et al. | 204/244 |
| 3,562,134 | 2/1971 | Love | 204/244 |

*Primary Examiner*—R. L. Andrews

*Attorney, Agent, or Firm*—Michael A. Ciomek; Eugene J. Kalil

[57] ABSTRACT

Directed to the electrolytic purification of molten magnesium chloride cell feed and to a covered cell design therefor wherein preferably a plurality of bipolar electrodes are employed. A current density of about 0.8 to about 1.5 amperes per square inch D.C. is employed, flow of the electrolyte through the cell proceeds in a non-turbulent manner through flow passages in the electrodes, and the solid impurities deposited electrolytically are removed periodically by mechanical action.

10 Claims, 3 Drawing Figures

MOLTEN SALT ELECTROSTRIPPING CELL AND METHOD FOR PURIFYING MOLTEN SALT ELECTROLYTES

This invention is directed to electrolytic purification of molten salt electrolytic cell feeds such as molten magnesium chloride to remove therefrom impurities, such as iron manganese, oxides, hydrochlorides, and the like, which interfere with the subsequent electrolysis operation to produce metal and chlorine, and to a cell design particularly adapted for the purpose of carrying out the method.

BACKGROUND OF THE INVENTION AND THE PRIOR ART

Magnesium metal is most commonly obtained by the electrolysis of molten magnesium chloride ($MgCl_2$). The concentration of the magnesium chloride fed to the cell should be as high as possible, e.g., 93% or more by weight. In addition oxychloride content, carbon content and heavy metal content such as iron, nickel, manganese, etc. should be as low as possible. For example, iron should be maintained below 600 ppm in the magnesium chloride fed to high efficiency sealed magnesium cells (designed for minimal sludge growth and removal) as otherwise a spongy iron deposit occurs which tends to create shorts and shorten cell life. The current efficiency of I.G. Farben type cells can be improved by about 2.5% through the use of purified feed, e.g., from about 78% to 80%. The I.G. Farben type low efficiency cells are designed to provide frequent sludging operation.

It is to be understood that molten magnesium chloride reacts strongly with the oxygen and moisture content of air with which it may come in contact. Such an occurrence causes release of hydrogen chloride fume to the workplace, a highly undesirable event, along with a concomitant increase in the oxygen content of the molten bath. Accordingly, contact of magnesium chloride electrolyte and air is to be avoided.

The treatment of magnesium chloride to remove oxygen by chlorination using iron catalyst results in residual iron as an impurity which may be present in the amount of 0.4% or more by weight. For efficient operation of electrolytic cells, particularly sealed cells, the iron content has to be reduced to a value not exceeding 600 ppm. The present invention is directed to a means and method for purifying molten magnesium chloride electrolyte.

BRIEF SUMMARY OF THE INVENTION

It has been found that the impurity content of molten magnesium chloride can be reduced to low levels by direct current electrolysis, preferably in a bipolar cell of special design.

DETAILED DESCRIPTION OF THE INVENTION

In accordance with the invention, impure, molten magnesium chloride electrolyte is electrolyzed at a direct current voltage insufficient to liberate magnesium therefrom to reduce impurity contents to low levels. In particular, iron is reduced to levels below 600 ppm, e.g., below 500 ppm in the form of metallic iron which settles to the bottom of the electrolyte container as a sludge and is removed from the electrolyte. A current density in the range of about 0.8 to 1.5 amperes per square inch is appropriate.

Figure 3:
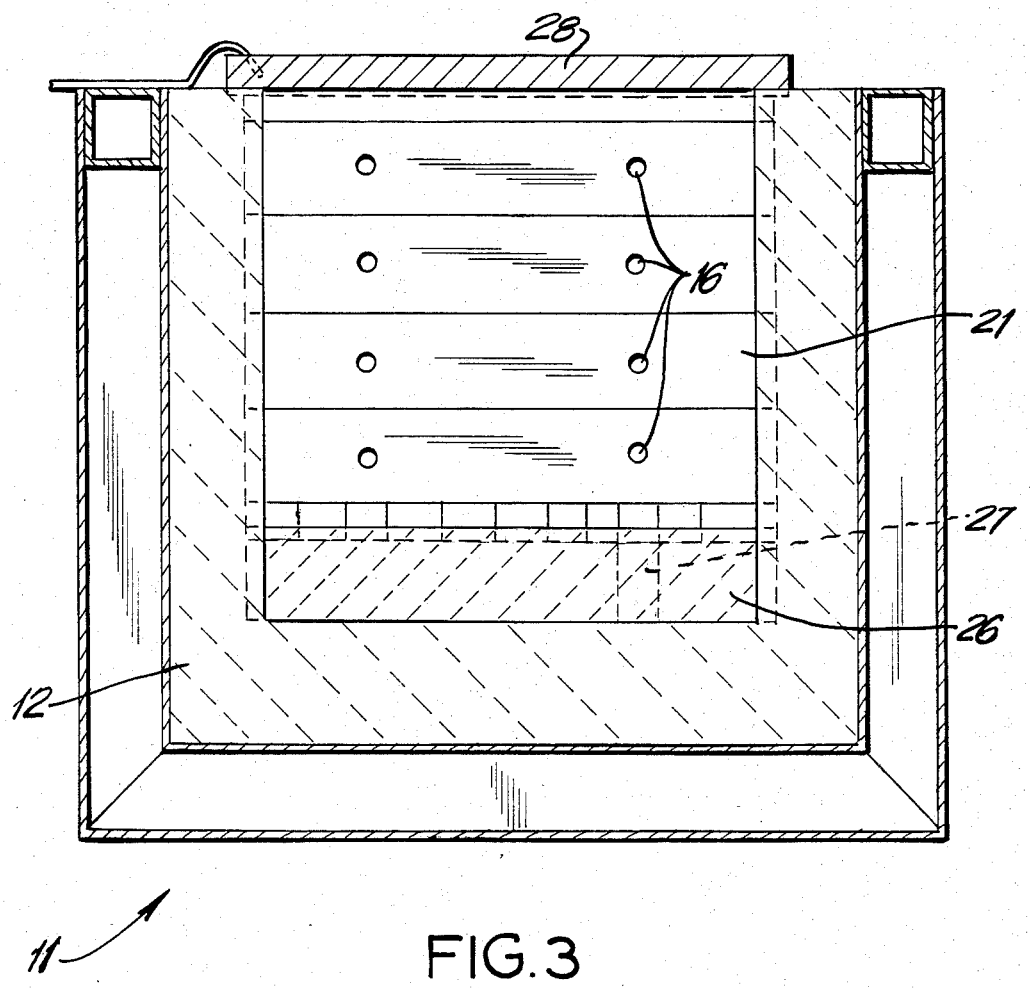
FIG. 3 depicts a frontal view of an electrode employed in the cell of FIGS. 1 and 2 as viewed along lines 3—3 of FIG. 2.

The invention will now be described with reference to the drawing in which reference character 11 depicts an elongated steel tank or container which is lined on the bottom, sides, and ends with refractory 12 to define a cavity which is substantially filled with molten magnesium chloride electrolyte 13. The electrolyte level will in operation be maintained between the points A and B, leaving a gas space 14 above the electrolyte level. The cell is illustrated in bipolar configuration with main anode 15 being located in feed compartment 18, main cathode 19 being located in product compartment 20 and with bipolar electrodes 21 being spaced substantially equally between main anode 15 and main cathode 19. Feed compartment 18 and product compartment 20 are isolated in the gas space by refractory dams 22 and 23. Power connections to main anode 15 and main cathode 19 are shown at 24 and 25, respectively, and are the only power connections necessary to the cell, thereby greatly simplifying the electrical problems as compared to those existing with a plurality of parallel-connected anodes and cathodes. Except for the gas-space dams 22 and 23, the feed compartment 18 and the product compartment 20 are open to the bipolar electrode compartment. Bipolar electrodes 21, which may be made of graphite, are fitted with a plurality of electrolyte flow-through passages 16 so that electrolyte may flow through the cell in a substantially non-turbulent manner from the feed end to the discharge end. Electrodes 21 are mounted on piers 26 made of refractory. As shown in FIG. 3, a gap 27 is left in each pier 26 to permit insertion of a lifting hook when worn electrodes are to be removed. The bottoms of main anode 15, main cathode 19 and bipolar electrodes 21 all lie in substantially the same horizontal plane. Thus, the main electronic path and main flow path for electrolyte through the cell is constituted by flow passages 16 through the electrodes. The main anode advantageously is made of graphite and is water cooled. The cell is covered with water cooled lids 28 which are fitted to the top surfaces of the cell sides and to each other with labyrinth seals. Each bipole compartment 29 and each bipolar electrode is fitted with a lid. In addition the feed or inlet compartment 18 and the product or outlet compartment 20 are fitted with lids 30 and 31, respectively. Lids 30 and 31 interlock with adjacent bipole lids 28 to form a seal. The feed compartment lid 30 is fitted with drop chute 32 adapted to deliver impure electrolyte to the feed or inlet compartment while product or outlet compartment lid is fitted with a sealable opening 31*a* to receive the suction pipe which withdraws purified electrolyte from product compartment 20. A gas off take 33 is provided in the feed compartment lid.

In operation, current passing from anode to cathode heats the electrolyte to operating temperature which, in the case of magnesium chloride electrolyte is in the range 1470° F.±40° F. AC electrodes can be provided for auxiliary heating, if needed. Both feeding of impure electrolyte and withdrawal of purified electrolyte are most conveniently performed in batch of semi-batch fashion having regard for the need to protect the product purified electrolyte from the atmosphere. Withdrawal is accomplished by vacuum into a truck which carries the purified salt to the extraction cells. Withdrawal of electrolyte causes a drop in electrolyte level within the cell and fresh feed addition causes an increase in level. Operation is conducted to maintain the level between points A and B. Overfilling must be avoided as severe damage to equipment and escape of fume to the workplace then occurs.

Figure 1:
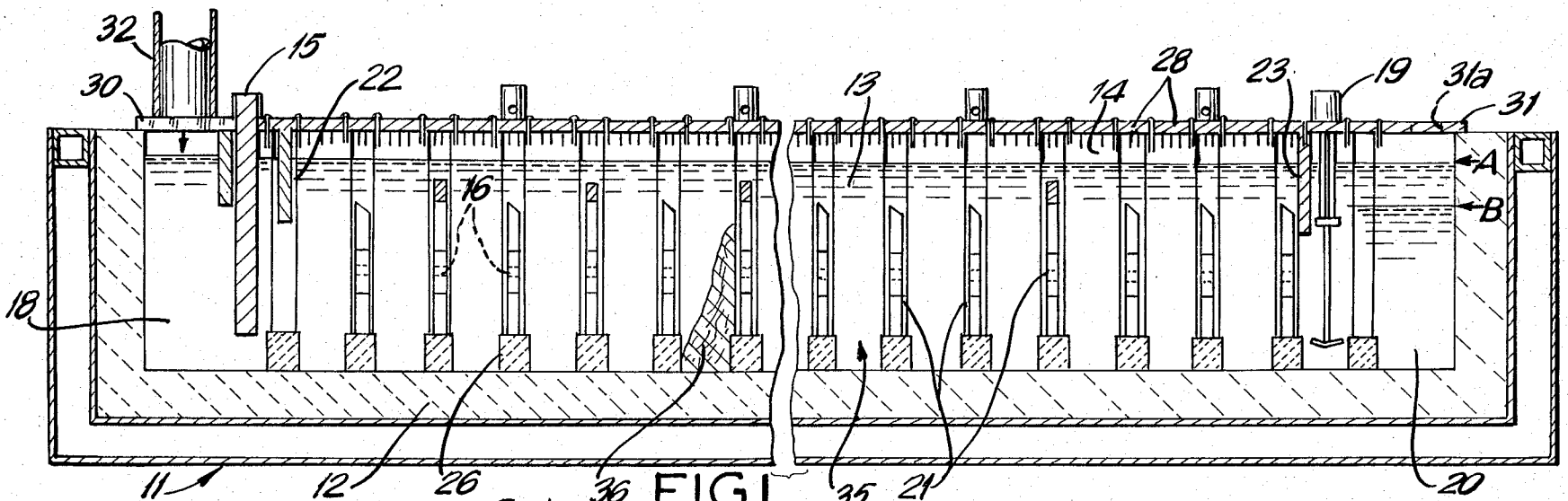
FIG. 1 depicts, in sectional elevation, a cell for carrying out electrolytic purification.
Figure 2:
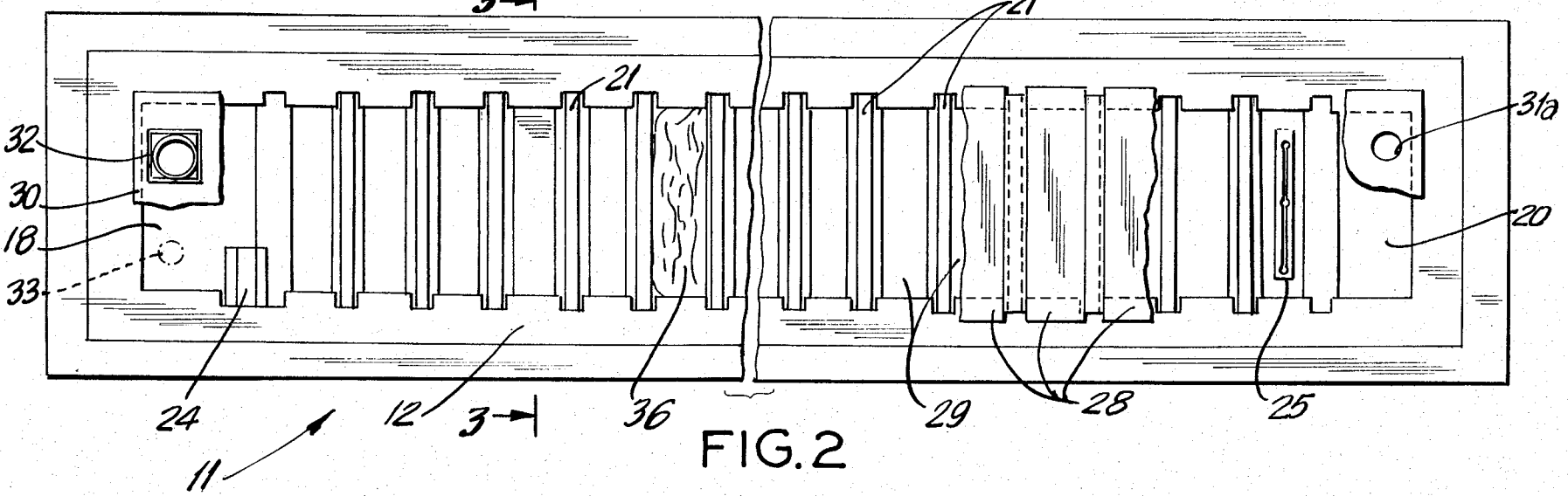
FIG. 2 depicts a plan view of the cell shown in FIG. 1 with the lid removed.

Passage of current through the cell causes deposition of iron sludge or smut on the cathodic faces of the bipolar electrodes. This sludge slumps into the sump area 35 beneath the bottom of the bipolar electrodes 21. As deposition of the iron sludge continues, it builds up on the cathodic face of the bipolar electrode 21 in the manner illustrated at reference character 36 in FIG. 1. The volume of sludge generated electrolytically in accordance with the invention necessitates removal periodically so that operation of the cell may be continued. This is done using a backhoe. Spacing of electrodes 21 must be sufficiently great to permit insertion of the backhoe bucket without damaging the electrodes. Provision of individual lids 28 over bipole compartments 29 restricts access of atmospheric oxygen to the surface of the molten electrolyte during the sludge removal operation. Escape of fume to the workplace area is minimized by use of a push-pull hood over the single open bipole compartment during the sludge removal operation coupled with use of a fan pushing air across the compartment to a suction hood placed on the opposite side of the compartment from the backhoe operation.

An example will now be given:

A bipolar cell constructed as shown in the drawing was operated semicontinuously to remove iron from a magnesium chloride electrolyte. The cell was provided with a water-cooled graphite anode in the feed compartment, 17 graphite bipolar electrodes spaced 24 inches apart in the electrode compartment and a steel cathode in the product compartment. The upper ends of the bipolar electrodes projected into the gas space above the electrolyte even at the highest electrolyte level and electrolyte level varied over about 10 inches by controlled rate addition of fresh impure feed and withdrawal of purified electrolyte. The bipolar electrodes were 58.5 inches high, 5 inches thick and 81.25 inches wide. With the edges of the electrodes being inletted into the sidewalls of the cell, a 76" wide surface was presented to the electrolyte, 8 holes 2 inches in diameter and substantially equally spaced vertically were drilled in each electrode to permit electrolyte flow. The electrodes stood on refractory piers extended 18 inches above the floor of the cell.

Electrolyte was fed at the rate of about 18,000 pounds per hour and the iron content was reduced from about 0.4% in the feed to about 0.05% in the product. Current was passed at an average of about 145 volts and 7500 amperes. Cell resistance was about 0.0146 ohms.

The following Table represents the cell material balance.

| | Feed(1) | | Air Infiltration | | Product | | Smut | | Offgas | |
|---|---|---|---|---|---|---|---|---|---|---|
| Component | #/Day | % | #/Day(2) | Moles/Hr | #/Day | % | #/Day | % | #/Day | Moles/Hr |
| $MgCl_2$ | 430,723 | 93.72 | | | 426,367 | 94.75 | 5,583 | 70.42 | | |
| MgO | 460 | 0.10 | | | 0 | 0 | 0 | 0 | | |
| $Mg(OH)_2$ | 460 | 0.10 | | | 186 | 0.04 | 0 | 0 | | |
| C | 691 | 0.15 | | | 225 | 0.05 | 322 | 4.07 | | |
| $FeCl_2$ (3) | 4,228 | 0.92 | | | 488 | 0.11 | 6 | 0.08 | | |
| NaCl | 9,904 | 2.16 | | | 9,776 | 2.17 | 128 | 1.61 | | |
| KCl | 4,606 | 1.00 | | | 4,547 | 1.01 | 59 | 0.74 | | |
| LiCl | 4,146 | 0.90 | | | 4,092 | 0.91 | 53 | 0.67 | | |
| $CaCl_2$ | 4,376 | 0.95 | | | 4,319 | 0.96 | 56 | 0.71 | | |
| Fe | | | | | | | 1,645 | 20.70 | | |
| $Cl_2$ | | | | | | | | | 828 | 0.5 |
| HCl | | | | | | | | | 360 | 0.4 |
| $CO_2$ | | | | | | | | | 1,204 | 1.1 |
| $O_2$ | | | 10,854 | 14.1 | | | | | 10,311 | 13.4 |
| $N_2$ | | | 35,728 | 53.2 | | | | | 35,728 | 53.2 |
| $H_2O$ | | | 233 | 0.5 | | | | | 233 | 0.5 |
| Mg | | | | | | | 79 | 1.00 | | |
| Total | 459,594 | 100.0 | 46,815 | 67.8 | 450,000 | 100.0 | 7,931 | 100.0 | 48,664 | 69.0 |

(1) 185 lb/day carbon from anode wear is accounted for in the product, smut and offgas streams.
(2) Average air infiltration is 500 CFM.
(3) Feed Fe = 0.4%; Product Fe = 0.05%.

While the invention has been described and illustrated in relation to the purification of molten magnesium chloride, it is to be understood that the invention is also applicable to the purification of molten aluminum chloride cell feed to electrolyze aluminum, wherein the purification of $NaCl/AlCl_3$ mixture is carried out.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. The method for electolytically purifying molten magnesium chloride cell feed in a compartmentalized cell having inlet and outlet compartments which comprises establishing a bath of said magnesium chloride cell feed, passing electric current through said molten chloride at a current density less than that required to liberate magnesium from said molten bath to precipitate at least one impurity metal at a cathodic face disposed in a compartment of said cell and immersed in said molten magnesium chloride, while allowing said precipitated impurity to settle at a location beneath said cathodic face, removing purified magnesium chloride from the outlet compartment of said bath, introducing fresh impure molten magnesium chloride to the inlet compartment of said bath and transporting said molten chloride through said bath between said inlet and outlet compartments in a non-turbulent manner so as to avoid reincorporating said precipitated impurity material in said bath.

2. The method in accordance with claim 1 wherein said precipitated impurity material is removed mechanically from said bath.

3. The method in accordance with claim 1 wherein said bath is led under substantially laminar flow conditions from said inlet compartment to said outlet compartment through perforations in a plurality of compartmentalized bipolar electrodes immersed therein.

4. The method in accordance with claim 1 wherein said current is passed through said molten electrolyte at a current density of about 0.8 to about 1.5 amperes per square inch.

5. The method in accordance with claim 1 wherein a gas space is maintained above said molten electrolyte and access of atmospheric air to said gas space is restricted.

6. The method in accordance with claim 3 wherein the path from said introduction point to said removal point is substantially elongated in relation to the cross-section of bath, and said bipolar electrodes are spaced substantially equally and well apart to provide a pool of electrolyte between each pair of said compartmentalized electrodes, the pool in one compartment communicating with the pool in the other through openings in said electrodes and through the compartmentalized space beneath said electrodes.

7. An electrolytic cell for purifying fused magnesium chloride cell feed comprising an elongated covered container, an anode compartment having a main anode located at one end of said container, a cathode compartment having a main cathode at the other end of said container and a plurality of bipolar electrodes disposed between said anode and said cathode to divide said cell into multiple series compartments such that, in operation, electrolyte level is substantially the same in each of said compartments and a gas space is provided above said electrolyte level, means for feeding impure molten magnesium chloride melt to said anode compartment and means for removing purified magnesium chloride cell feed from said cathode compartment, flow-through passages in each of said bipolar electrodes to provide substantially non-turbulent flow of said melt through said cell from said anode compartment to said cathode compartment, a sump beneath said electrodes for collecting the smut generated during the purification process, direct current supply means providing current to said anode and said cathode at a voltage insufficient to liberate magnesium from said melt but sufficient to liberate iron impurity therefrom, tightly-fitting removable and replaceable water cooled metal covers over each of said compartments, said bipolar electrodes being spaced apart sufficiently to permit insertion therebetween of a tool to remove said smut.

8. An electrolytic cell in accordance with claim 7 wherein a gas space is provided above said fused electrolyte and said main cathode and said main anode are in compartments divided in the gas space from said bipolar electrodes.

9. An electrolytic cell in accordance with claim 7 wherein said electrolyte removal means are vacuum means.

10. An electrolytic cell in accordance with claim 7 wherein said bipolar electrodes are made of graphite.

* * * * *